US012201165B2

(12) United States Patent
Harris et al.

(10) Patent No.: US 12,201,165 B2
(45) Date of Patent: Jan. 21, 2025

(54) ADJUSTABLE, CLEAVAGE ENHANCING UNDERGARMENT SYSTEM

(71) Applicant: CA Sky Holdings Inc., West Hollywood, CA (US)

(72) Inventors: Amanda M. Harris, West Hollywood, CA (US); Alistair Black, Los Gatos, CA (US)

(73) Assignee: CA SKY HOLDINGS, LLC, West Hollywood, CA (US)

( * ) Notice: Subject to any disclaimer, the term of this patent is extended or adjusted under 35 U.S.C. 154(b) by 275 days.

(21) Appl. No.: 17/723,902

(22) Filed: Apr. 19, 2022

(65) Prior Publication Data

US 2023/0061954 A1 Mar. 2, 2023

Related U.S. Application Data

(60) Provisional application No. 63/237,713, filed on Aug. 27, 2021.

(51) Int. Cl.
*A41C 3/00* (2006.01)

(52) U.S. Cl.
CPC ..... *A41C 3/0028* (2013.01); *A41C 3/005* (2013.01)

(58) Field of Classification Search
CPC ..... A41C 3/0028
USPC ..... 450/41, 45, 46, 48, 53
See application file for complete search history.

(56) References Cited

U.S. PATENT DOCUMENTS

| | | | | |
|---|---|---|---|---|
| 2,505,720 | A * | 4/1950 | Cooper-Smith | A41C 3/124 128/889 |
| 2,844,151 | A * | 7/1958 | Lemons | A41C 3/10 450/80 |
| 2,900,981 | A * | 8/1959 | Herbener | A41C 3/06 450/48 |
| 3,196,878 | A | 7/1965 | Hedu | |
| 3,608,556 | A | 9/1971 | Paterson | |
| 5,433,648 | A * | 7/1995 | Frydman | A42B 1/22 24/71 ST |
| 6,390,884 | B1 * | 5/2002 | Dragojevic | A41C 3/0028 450/71 |
| 6,761,614 | B2 * | 7/2004 | Pinna | A41C 3/065 450/41 |
| 6,780,081 | B2 * | 8/2004 | Chen | A41C 3/065 450/54 |

(Continued)

FOREIGN PATENT DOCUMENTS

| | | |
|---|---|---|
| KR | 200475282 | 11/2014 |
| KR | 101802085 | 11/2017 |

*Primary Examiner* — Jocelyn Bravo
(74) *Attorney, Agent, or Firm* — KARISH & BJORGUM, PC

(57) ABSTRACT

An adjustable, cleavage-enhancing undergarment system is described. In one embodiment, a compression paddle includes a first surface contoured to engage with at least a portion of a user's breast. The compression paddle may include a mechanical coupling configured to engage with an end of a force generating member. The compression paddle may include a locking mechanism configured to engage a rotational state wherein the compression paddle is configured to rotate about an axis that is substantially coaxial to the end of the force generating member, and engage a locked state wherein the compression paddle is mechanically locked at an angular position selectable by the user.

16 Claims, 17 Drawing Sheets

(56) References Cited

U.S. PATENT DOCUMENTS

| | | | | |
|---|---|---|---|---|
| 7,048,761 | B2 * | 5/2006 | Ajili | A41C 3/065 623/7 |
| 9,565,878 | B2 * | 2/2017 | Hernandez | A41C 3/065 |
| 10,058,132 | B2 * | 8/2018 | Harris | A41C 3/06 |
| 2003/0220048 | A1 | 11/2003 | Toro et al. | |
| 2005/0081865 | A1 | 4/2005 | Hubert et al. | |
| 2005/0266770 | A1 | 12/2005 | Henricksen | |
| 2007/0264905 | A1 * | 11/2007 | Horta | A41C 3/124 450/41 |
| 2010/0210178 | A1 * | 8/2010 | Chang | A41C 3/0028 450/81 |
| 2012/0028540 | A1 * | 2/2012 | Schmell | A41C 3/06 450/55 |
| 2014/0259301 | A1 * | 9/2014 | Berns | A43C 9/00 2/336 |
| 2015/0044941 | A1 * | 2/2015 | Luxi | A41C 3/10 450/41 |
| 2016/0037832 | A1 | 2/2016 | Kogan et al. | |
| 2016/0302492 | A1 | 10/2016 | Sobah | |
| 2017/0172220 | A1 | 6/2017 | Sung | |
| 2018/0213853 | A1 * | 8/2018 | Harris | A41C 3/0078 |

* cited by examiner

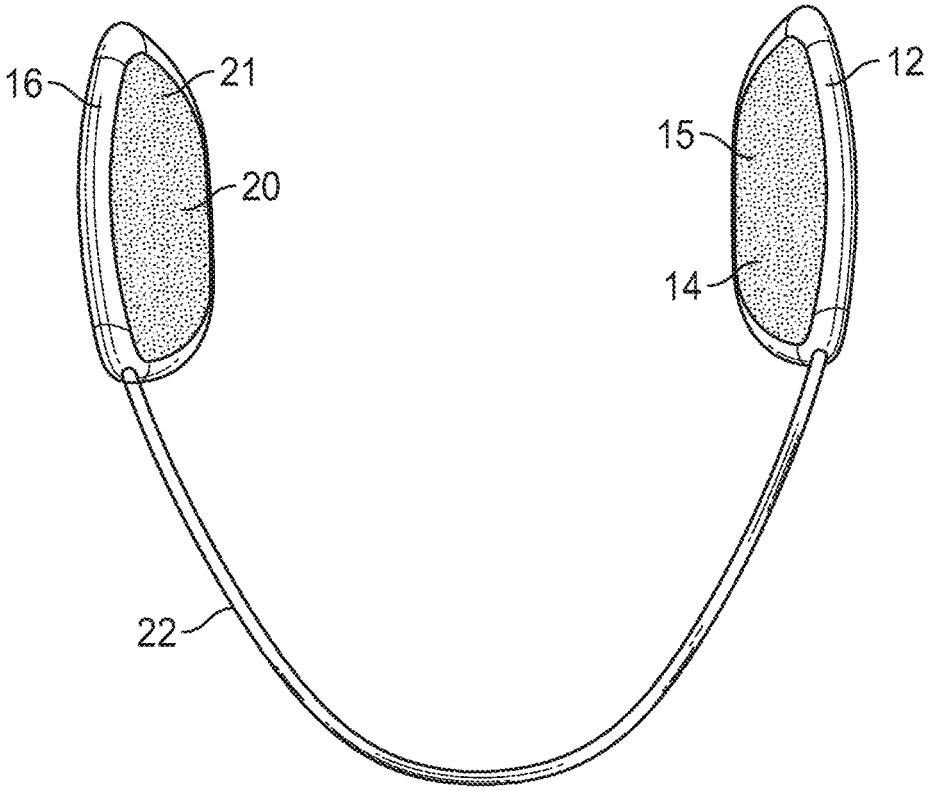
PRIOR ART FIG. 1
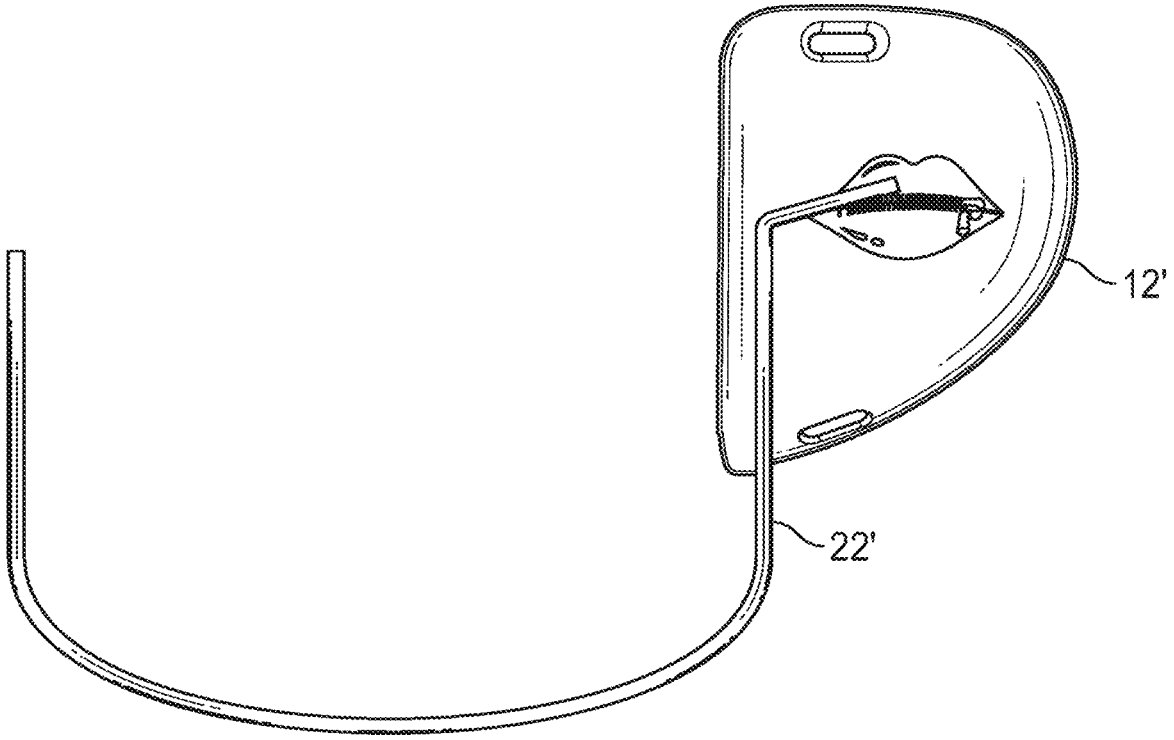
PRIOR ART FIG. 2

Volumizing Pad Outside

Pocket Wall

Paddle

Pocket Wall W Embedded Anti Skid

Breast

Volumizing Pad Outside

Pocket Wall

Paddle W High Friction

Pocket Wall

Anti Skid

Breast

Volumizing Pad Outside

Pocket Wall

Paddle

Anti Skid

Pocket Wall

Anti Skid

Breast

ADJUSTABLE, CLEAVAGE ENHANCING UNDERGARMENT SYSTEM

RELATED APPLICATIONS

The present disclosure is part of a non-provisional patent application claiming the priority benefit of U.S. Patent Application No. 63/237,713, filed on Aug. 27, 2021, which is incorporated by reference in its entirety.

TECHNICAL FIELD

The present invention relates generally to the field of undergarment systems worn by women, and particularly to such a system having an open front and an enhancing element that adjustably increases the cleavage, as well as give the appearance of lift by plumping the breasts of a woman wearing the undergarment.

BACKGROUND

Bras have been used to cover, support and enhance a woman's breasts for many years. Bras typically have over-the-shoulder straps, cups for each breast, a strap or straps around the back and a strap connecting the cups in the front.

Bras are typically worn under clothing and are not visible to others. Over the years, the bra has undergone many changes. For example, while the bra was at one time a method of concealment, it has more recently become a tool to enhance the shape lines of the wearer. This has been evidenced in recent years by the extreme popularity of cleavage enhancing bras. A trend in women's clothes has been toward more revealing clothes, driving a similar trend in bras to be smaller, thinner and less obtrusive. For example, strapless bras are useful for women wearing clothing that reveals the upper part of the shoulders. Even so, presently available bras which are designed to enhance a wearer's cleavage are either not structured to be worn or unable to work effectively when worn under certain elegant, stylish garments which are strapless, or which offer a lowcut plunging neckline or a bare back look. Lowcut dresses with plunging necklines that reveal the area on the chest of a woman between the breasts must sometime be worn braless. Typically, this exposes a gap between the breasts of the wearer and does not provide desired cleavage or extra enhancement of actual breast size.

As such types of dresses and other garments have become popular, there remained a need in the art for bras or other types of undergarments that not only enhance the wearer's breast size and cleavage, but which further can effectively do so without the use of straps about the shoulders or the wearer's back or beneath the breasts of the wearer.

Several conventional bras known in the art utilize various inserts and bindings to achieve the enhancement of the wearer's cleavage. However, many of these devices are uncomfortable to the wearer and further have resulted in surface irregularities such as one or more bumps or protrusions that are visible and highly noticeable even through the wearer's clothing or outer garments. Thus, until recently, there remained a need in the art for a bra that not only enhances the wearer's breast size and cleavage but also provides the appearance of lift and further which is comfortable to wear, will not create back bulge due to the force of the straps pushing into the flesh of the wearer, will not have heavy straps that cut into the shoulders of the wearer causing pain, and which will not cause surface irregularities that would be visible through a wearer's clothing or other garments.

U.S. Pat. No. 10,058,132 to Harris, et al, titled "Cleavage Enhancing Undergarment System" ("the '132 patent") effectively addressed these problems and more by disclosing a revolutionary bra-like undergarment design the inventors therein called a "braette" that does not require any straps over the wearer's shoulders or around the back or between the breasts supporting portions of the garment. Instead, the '132 patent discloses a frontless, backless and strapless braette design adapted to provide enhanced breast size appearance and cleavage of the breasts of a wearer by including a first compression "pad" (in the present invention described hereinafter, this component is called a "paddle" or "compression paddle") having an inner and outer surface, the inner surface being contoured to engage the outer side of one breast of the wearer, a second compression pad having an inner and an outer surface, the inner surface being contoured to engage the outer side of the other breast of the wearer, and a force-generating member having first and second ends connected to said first and second compression pads, respectively, and extending downwardly, away from the breast of the wearer toward the abdomen of the wearer to push the breasts of the wearer toward each other to provide the enhanced breast size appearance and cleavage. Various embodiments of the inventive braette are disclosed in the '132 patent.

In the '132 patent, FIGS. 1-4 and corresponding description from column 3, line 40 to column 4, line 18, explain the function and operation of the force-generating member 22 in conjunction with the compression pads (herein referred to as "paddles") of the inventive braette. FIG. 1 (which is a reproduction of FIG. 3 of the '132 patent), shows a perspective view of a braette according to that invention having a force-generating member 22 that is preferably a shaped, deformable metal beam or rod having its ends permanently connected to or molded into compression pads 12 and 16 that supply the inward-directed forces to the outer sides of the breasts of the wearer. FIG. 2 conceptually shows how, in one Misses Kisses™ production model, one end of the force-generating metal rod member 22' is secured to and bent inside a paddle 12'. The rod end is sonic welded in a clamshell closure paddle design. Accordingly, the '132 patent explains: "The preferred manner in which the compression pads are connected to the first and second ends (not shown in FIGS. 1 through 3) of the force-generating member is by in situ injection molding of the compression pads 10 [sic] and 16 around the ends of the force-generating member 22. The force-generating member 22 is preferably a beam or rod constructed of metal in this embodiment and more preferably that metal is steel and can be cold rolled steel or spring steel, or if desired, the steel may be heat treated in manners well known to the prior art. The function of the force-generating member 22 is to apply an inwardly directed force to the compression pads 10 [sic] and 16 to cause them to push the breasts together and also to provide the appearance of lift to the breasts to enhance the breast size and cleavage. It is therefore an important feature of the present invention that the metal beam or rod retain its resilience so it can be repeatedly used. Also, the wearer may adjust the amount of force to be applied to the breasts by bending the beam or rod." ('132 patent, col. 3, line 41-line 59, emphasis added.)

Thus, as seen in the illustrative perspective view of a genuine Misses Kisses™ production bra design (without cover pads) of FIG. 3, braette 10 may be adjusted in a number of directions. Arrows 30 and 30' indicate that paddles 12 and 16 may be forcibly rotated in the direction shown or in the opposite direction to fit larger or smaller breast sizes, respectively ("rotational adjustment"). Moreover, metal rod 22 may be manually bent outwardly in the direction shown by arrow 32 to reduce the amount of inward force applied to the outer sides of both breasts. Or, rod 22 may be bent inwardly-positioning paddles 12, 16 closer together in order to increase the force on the breasts to increase the cleavage effect ("compression force adjustment"). Finally, paddles 12 and 20 may be "splayed" outwardly in the directed shown by arrows 34, 34' or in the opposite direction ("splay adjustment").

As further explained in the '132 patent, "In utilization of the structure as illustrated in FIGS. 1 through 3 [of the '132 patent], the wearer would separate the compression pads 10 [sic] and 16 by pulling them outward and would then apply the inner surfaces 14 and 20 of the compression pads to the outer surface of the wearer's breasts and release the compression pads 12 and 16. At this point, the metal force-generating member would urge the compression pads toward each other and apply a force, typically between 1 and 5 lbs., directed inwardly against the outer surfaces of the breasts of the wearer, causing the breasts to be pushed together to enhance the cleavage and to provide the appearance of lift to the breasts of the wearer to enhance the breast size." ('132 patent, col. 3, line 59-col. 4, line 4.) Thus, two features of the disclosed metal beam force-generating member 22 are resilience and adjustability: resilience, so that it can repeatedly hold the compression pads 10 [sic] and 16 in the same place with the same inward force and orientation use after use; and adjustability, so that the wearer, at an initial set up or "fitting," can bend the beam member in at least two dimensions, by (a) twisting the ends of the beam connected to the pads so that the pads are rotationally oriented relative to the size and shape of the breasts of the wearer; and (b) bending the beam itself, so that the paddles are more or less pushed together.

Referring back to FIG. 2, (and as seen in FIG. 4 of the '132 patent), in order to enable secure rotational adjustment, the terminal portions 28, 30 of metal beam 22 " . . . are bent at substantially right angles to the longitudinal axis of the metal beam 22 . . . . Such configuration is then totally encapsulated within the molded plastic compression pads 10 [sic] and 16. By being bent in this manner, the metal beam 22 is securely retained within the compression pads 10 [sic] and 16 at all times." ('132 patent, col. 4, lines 11-18.) This design enabled a one-size-fits-all system, enabling the user at initial set up to rotationally bend the beam by forcibly rotating the paddles a new position that best fits the wearer's breasts' size and shape. This set-up operation is demonstrated by co-inventor Harris in her explainer video using a braette made according to the '132 patent found at https://vimeo.com/484916793 (see, e.g., from time-stamp 3:35 (minutes:seconds) to 5:26). As explained therein, the smaller the breasts of wearer, the "flatter" the compression paddles need to be relative to the chest of the wearer. By contrast, the larger the breasts of the wearer, the more perpendicular the pads need to be relative to chest of the wearer. Indeed, in the video Ms. Harris demonstrates approximate degrees of pad rotation appropriate for various breast sizes (e.g., B, C, D, etc.). The video also shows the substantial force needed to both rotate the paddles to fit the user and the force needed to bend the metal beam to adjust for cleavage amount. Finally, the video shows the use and application of soft, shaped pads into which the paddles are inserted in order to create comfort and to compensate for the loss of the natural shape of the outer side of the breasts that are compressed by the paddles.

Thus, while the pliable metal beam designs disclosed in the '132 patent, whose ends are permanently affixed to the paddles, accomplish these functions, they all require the person setting up the braette for the specific user (typically, the user herself) to manually apply a good amount of rotational and compression forces on the beam, which may be difficult for some users. The paddle adjustments are also imprecise: It may require multiple rounds of "trial and error" rotation in order to get the braette system to "fit" the user perfectly. Moreover, permanently integrating a twistable metal beam into paddles add significant weight to the system, can be difficult and costly to manufacture, has a significant manufacturing weakness in the case of sonic weld and is bulky to ship.

Accordingly, it would be desirable to have a solution that accomplishes the goals of the cleavage enhancing designs disclosed in the '132 patent, while overcoming the aforementioned drawbacks. It would also be desirable to have a force-generating member that is not permanently connected to the paddles, such that it can be easily replaced by the user herself with a replacement or with force-generating members having different plunge sizes and shapes (e.g., shallow plunge, medium plunge, or deep plunge).

It would be further desirable to have pads that are placed over the bra paddles that are easy to insert and provide an even more natural look to the breasts when wearing the systems of the present invention.

SUMMARY

The present invention meets these needs and more by disclosing cleavage enhancing bra systems and kits that incorporate selective adjustment features discussed herein in one or more dimensions. In one dimension, male-female mating mechanisms at the junctions of the ends of the force-generating member and the left and right paddles of the system enables selective rotation of the paddles to easily adjust and fix the paddles at angles appropriate to the user's breast size. In one preferred embodiment, each end of the force-generating member preferably terminates in a round, toothed, ratcheted nub or pin. Then, in the location of the left and right pads where the metal ends of the force-generating member in the '132 patent are inserted, female, toothed, ratcheted openings are adapted to removably receive ratcheted nubs or pins of the force-generating member.

In some embodiments, the bra system of the present invention includes improved compression force adjustment mechanisms by disclosing a force-generating member having an extendible crossbar to enabling its length to be adjusted. This enables the bra system to be easily made narrower or wider to create more or less cleavage action on the breasts.

The present invention also discloses improved pad technologies that provide a truly seemless look to the breasts when worn under clothing.

It is to be understood that the invention is not limited in its application to the details of construction and the arrangement of components described hereinafter and illustrated in the drawings and photographs. Those skilled in the art will recognize that various modifications can be made without departing from the scope of the invention.

BRIEF DESCRIPTION OF THE DRAWINGS

Further advantages of the present invention may become apparent to those skilled in the art with the benefit of the following detailed description of the preferred embodiments and upon reference to the accompanying drawings in which:

FIG. 1 is a diagrammatic perspective view of a cleavage-enhancing braette as disclosed in the prior art;

FIG. 2 is a partial cutaway perspective view of an illustrative rendition of part of a Misses Kisses™ "braette" in the prior art.

DETAILED DESCRIPTION OF THE PREFERRED EMBODIMENTS

Figure 3:
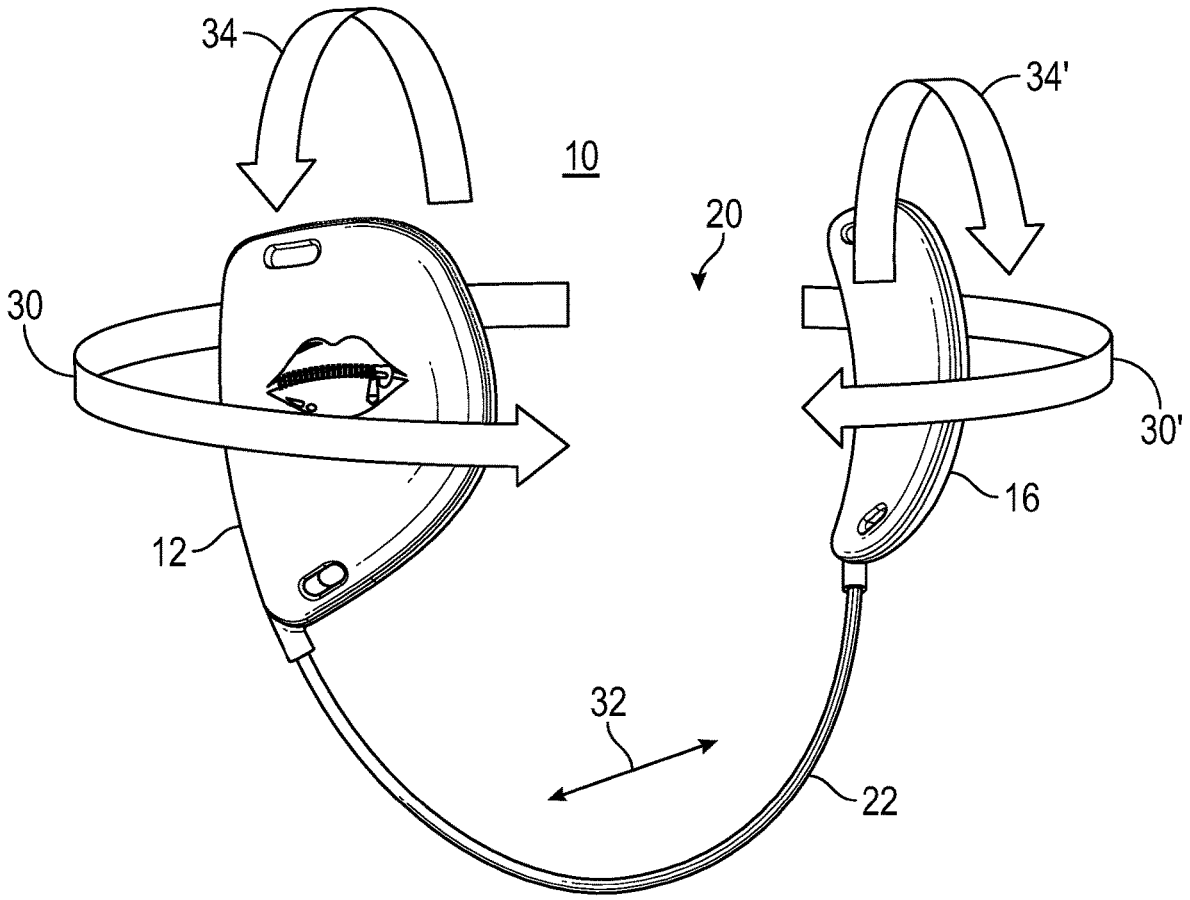
FIG. 3 is perspective view of a Misses Kisses™ braette showing optional adjustments addressed by the present invention.

Referring now to the drawings, like reference numerals designate identical or corresponding features throughout the several views.

Figure 4:
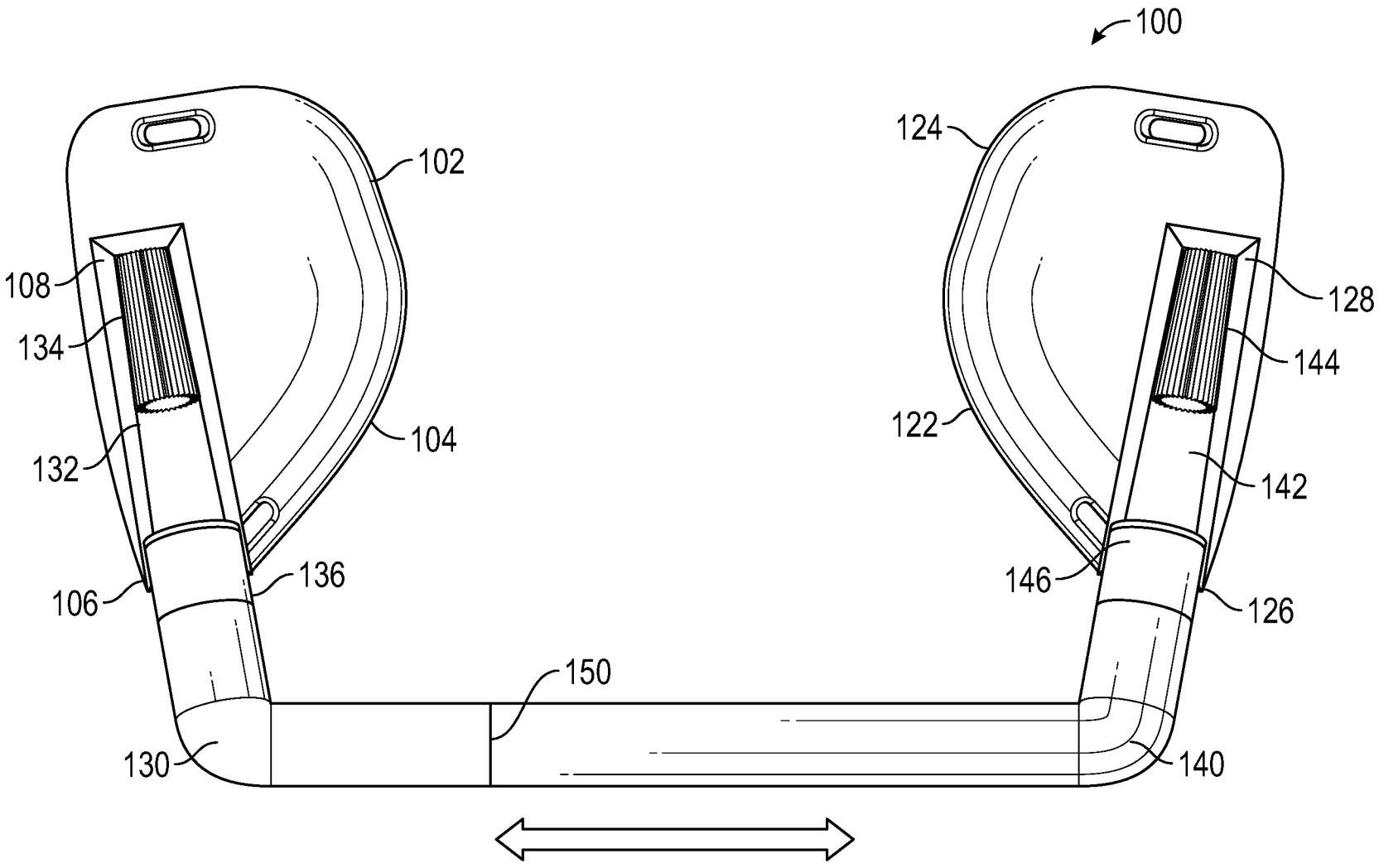
FIG. 4 is an illustrative perspective view of one embodiment of the present invention incorporating several inventive features.

In one preferred embodiment of the present invention, FIG. 4 shows a front, partial cutaway view of an illustrative, frontless, backless and strapless bra system 100 that functions to support a wearer's breasts while exposing front, back and shoulder portions of her body, and to provide an enhanced cleavage look. In this embodiment, system 100 combines two optional inventive features of user adjustability, namely, improved rotational adjustability and improved compression force adjustability. As seen, system 100 comprises four basic components, in the present embodiment preferably all made of lightweight but sufficiently sturdy injection-molded plastic: right breast paddle 102, left breast paddle 122, right support bar 130 and left support bar 140. It should be understood, however, that in some embodiments, only one of the two inventive adjustability features may be implemented, and different materials may be used for the components. For example, system 100 may optionally only provide the improved paddle rotational adjustability feature, in which case, a single force-generating support bar may replace the two support bar components 130, 140. In such embodiment, the support bars 130, 140 may optionally be replaced with a single bar or wire comprising, a pliable metal material as disclosed in the prior art, enabling the bar to offer conventional compression force adjustability, namely, by forcibly bending the bar as disclosed in the '132 patent. In yet other embodiments, the wire may not comprise the entire bar, but rather only a portion of the bar, with the wire ends connecting to other bar components that connect to paddles 102, 122.

As further seen in FIG. 4, right breast paddle 102 includes outer surface 104 and inner surface 106 (not shown) that when in use presses against the outer side of the user's right breast. Left breast paddle 122 has outer surface 124 and inner surface 126 (not shown) that when in use presses against the outer side of the left breast. Conically tapering cavities 108, 128, extend into the bodies of paddles 102, 122 respectively from openings 106, 126, respectively. Support bar components 130, 140 are, but need not be, elbow shaped and adjustably connect with each other at junction 150 as discussed further below. At their ends opposite junction 150, support bar components 130, 140 terminate in "pins" (alternatively herein called "posts" or "pegs") 132, 142, respectively, that, as seen in this embodiment conically taper to their respective ends 134, 144. Moreover, when assembling the components together, pin 132 may be inserted all the way into cavity 108 until an optional snap ring 136 snaps it into place. Likewise, when end 144 of pin 142 of left support bar 140 is inserted into cavity 128, pin 142 may optionally snap into cavity 128 via snap ring 146. Numerous design options for implementing rotational adjustability of paddles 102, 124, all obviating the need to forcibly twist metal force-generating members, and opening the option to use different materials for the system components, will now be discussed.

Rotational Adjustability: "Conical Friction"—In one embodiment of the rotational adjustability feature of the present invention, as seen in FIG. 4, when assembling system 100 together, paddles 102, 122 can be selectively fixed at desired angles relative to the plane defined by the assembled support bars 130, 140 (and the front chest and torso of the wearer) by simply pressing support bars 130, 140 into its mating paddle cavity 108, 128 at those desired angles. The paddle positions are kept from freely rotating about the axes defined their mating pegs based on the friction forces caused by the engagements of the pegs against the inner walls of the cavities into which they are inserted. As seen in this embodiment in which the bar ends are not yet fully pressed into their mating cavities, pegs 132, 142 preferably are conically tapered moving to their ends, and correspondingly, peg-receiving cavities 108, 128 are likewise conically tapered, each with a depth that is slightly deeper than the length of its mating peg. Thus, the deeper conical pin 132 is pressed into paddle cavity 108, the greater the wall friction created between outer surface of pin 132 and the inner circumference of the cavity 108. The force required to overcome the pin outer wall-to-paddle inner wall friction—i.e. the friction coefficient—can vary, but at a minimum it preferably should be sufficient to prevent the paddle from rotating off its selected position when placing the paddles on the wearer's breasts and when wearing the system 100. It should also be understood to one skilled in the art that the conical pin outer surface, its mating cavity inner circumference surface or both may have finishes that are not smooth or may include coatings that provide the desired coefficient of friction between the components when assembled. It should also be understood that when fitting the system for a particular user, the rotational angle of a paddle may be easily adjusted by simply pulling the paddle off its pin and reinserting it at a different angle. This enables the user to achieve a perfect fit with minimal effort. Note that in the case of the tapered pin, the disengagement of the peg from the cavity can be achieved by pulling the two apart only a small distance. This pulling apart can be achieved by hand or by a mechanical mechanism designed into the peg and cavity system such as a lever, button, or twisting spacer mechanism. Using a mechanism such as a twisting spacer will give the user an easy method of reducing the friction so the adjustment can be made with minimal effort. The mechanism when twisted the other way will then snap the peg and cavity together more tightly and freeze the paddle at the desired angle with respect to the front of the user.

Figure 5:
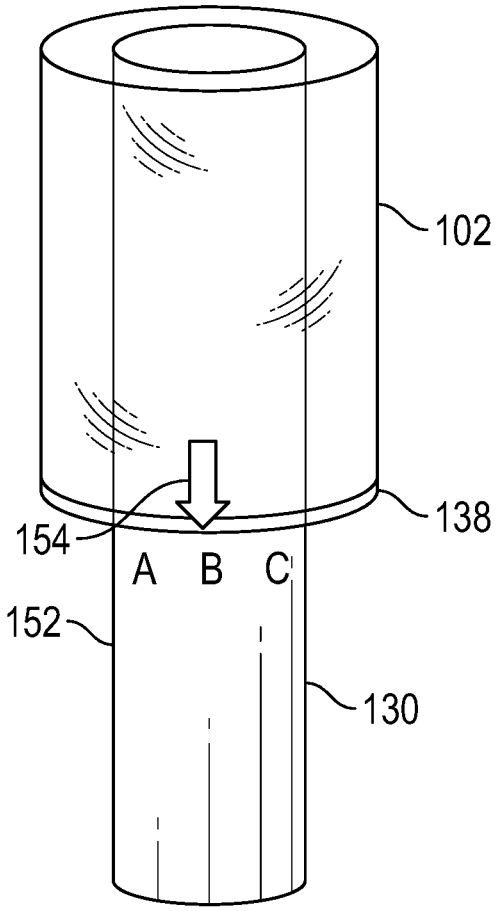
FIG. 5 is an illustrative perspective view of one selectably rotatable paddle solution for the system show in FIG. 4 in accordance with an embodiment of the present invention.

An additional option (in any rotational adjustability embodiment) to assist the user in selecting the best angular position of a paddle to match the breast size is the inclusion of an alphanumeric or other marking system at each paddle-support bar junction. Thus, as seen in the illustrative diagram of FIG. 5, paddle 102 (partial view) may include a downwardly oriented arrow 154 at its open end 138, and support bar 130 may include a set of letters, say A through F around its circumference (shown here in partial view A through C), at a location that aligns with arrow 154 when bar 130 is inserted into paddle 102. Thus, when the user assembles paddle 102 onto bar 130, before pressing and fixing them together, she can rotate the paddle so that arrow 154 aligns with the letter (or a number) that corresponds to her breast size. This may help eliminate the trial-and-error guesswork involved when setting up system 100 for the user, or at least reduce the number of times the user will need to adjust the paddles to obtain a good fit.

Figure 6A:
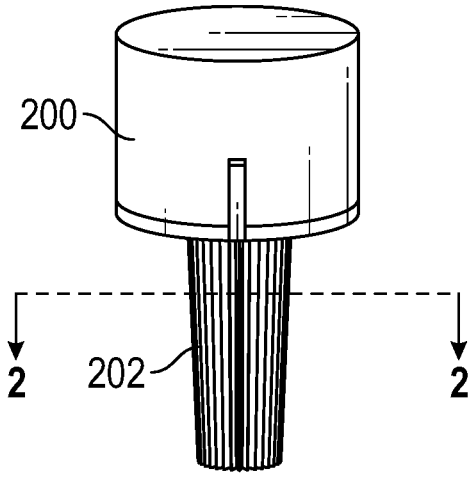
FIGS. 6A-6D show illustrative views of an adjustable, ratcheted male-female joint employed at a paddle-bar end junction enabling precise paddle rotational adjustment in accordance with one embodiment of the present invention.
Figure 6B:
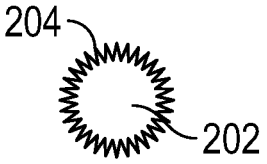
Figure 6C:
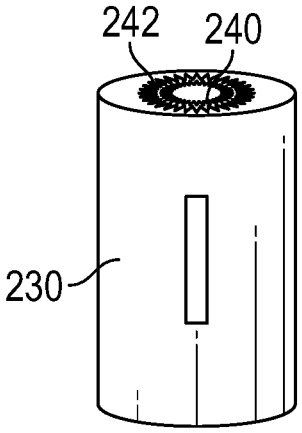
Figure 6D:
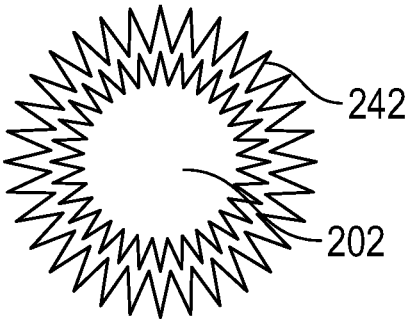

Rotational Adjustability—Teeth-to-Teeth Adjustment FIGS. 6A-6C disclose another rotational adjustability design, namely a teeth-to-teeth securing solution. This solution may replace or may preferably complement the "conical friction" embodiment disclosed in connection with FIG. 4. Similar to that design, pin 202 of force-generating bar component 200 (FIG. 6A) is inserted into paddle 230 cavity 240 (FIG. 6C) at a desire rotational angle. But now, as seen in the FIG. 6B birds-eye, cross-sectional view of pin 202 at 2-2, pin 202 has teeth 204 disposed around its tapered circumference. Correspondingly, the interior circumference of the wall defined by cavity 240 is disposed with mating teeth 242. Thus, when pin 202 is inserted into cavity 240, teeth 202 and 242 interlock, as seen in illustrative cross-sectional view of FIG. 60, and hold the paddle at the desired rotational angle relative to pin. This design effectively "locks" the paddle in place and prevents unwanted rotation under pressure in use.

Figure 7A:
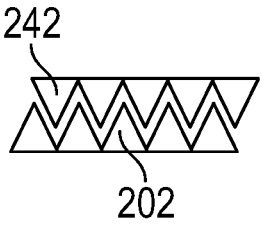
FIGS. 7A and 7B show further details and alternative selectably rotatable paddle solution disclosed in FIGS. 6A-6D.

One advantage of this design is that rotational adjustment of a paddle relative to its mating pin can be made without separating or lifting the paddle away from the peg. This is demonstrated in the examples shown FIGS. 7A and 7B. In FIG. 7A, mating teeth 202, 242 are straight so that paddle 230 may be rotated around pin 202 of bar 200 in either a clockwise or counterclockwise direction with precision "clicks," as the mating teeth forcibly pass over each other. As will be understood, the number of teeth 202, 242 on the components are a matter of design choice, with the greater the number of teeth corresponding to more positional granularity—i.e., each rotational "click" corresponds to a smaller angular displacement—and the fewer the teeth, the coarser the angular displacement. It is also understood that the conical friction design shown in FIGS. 4 and 6 need not be present in this teeth-to-teeth embodiment. However, it still may be desired to have the conical taper in this design as well and use the techniques described for the friction approach depending on the overall design goals Instead, pin 202 and its mating cavity 240 may be cylindrical. In any of these alternatives, paddle 230 may be clamped to pin 202 using any suitable technique as will be understood by those skilled in the art. For example, a horizontally disposed set screw or regular screw may be provided in paddle 230 to enable the user to securely tighten paddle 230 to pin 202.

Figure 7B:
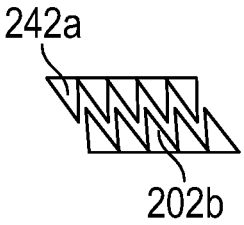

In an alternative interlocking teeth design shown in FIG. 7B, interlocking teeth 202*b* and 242*a* may be biased at an angle off the horizontal creating a one-way, "sawtooth" ratchet effect as shown. In this "ratchet-like" design, paddle 230 will rotate around pin 202 in one direction when the user applies sufficient rotational force, but will lock—not rotate—in the reverse direction. However, if a locking mechanism as describe above is provided and used, paddle 230 could be difficult to rotate even in the intended rotational direction.

In a variation of the interlocking teeth "ratchet design shown in FIG. 7B, the rotational adjustment components of the bra of the present invention, may be implemented in a metal-on-metal design. That is the force-generating bar may comprises a metal wire having pin ends that are conditioned to create a connection with the paddle that will not slip. In particular, each pin end terminates in a sleeve that is assembled over the end of the wire and is secured against rotational movement with respect to the wire. The pin has a larger diameter than the wire so there is more teeth that a wire-only design, and thus more resolution to adjustment of the paddle. The metal pin has metal teeth disposed around its circumference that interface with the metal teeth in the cavity. In this way, a ratchet effect is created between the teeth on the pin and the teeth in the cavity. The paddle cavity itself can be formed of a metal receptacle that is secured to the inside the paddle to not move. Alternatively, the cavity can be all plastic and part of the paddle molding itself.

Moreover, in this variation (and other metal wire variations), it is noted that the pin ends of the force generating member, that is the wire-sleeve combination, can optionally be made in such a way that each wire end can be inserted and removed from its mating sleeve so that different wire bars can be used with the same paddles. Thus, in operation, the wire bars can be made to be replaceable while the sleeve remains in (or is pre-assembled into) the paddle cavity as part of the paddle assembly. This adds flexibility for the user and can reduce the overall cost of the system. Thus, in this embodiment, the bra system may be sold as kit, with interchangeable wires of different shapes and depths. For example, such a kit can come with three force-generating wire components one that, when assembled creates a shallow plunge bra system, another wire that creates a mid-plunge system and a third that creates a deep plunge bra system.

Figure 8A:
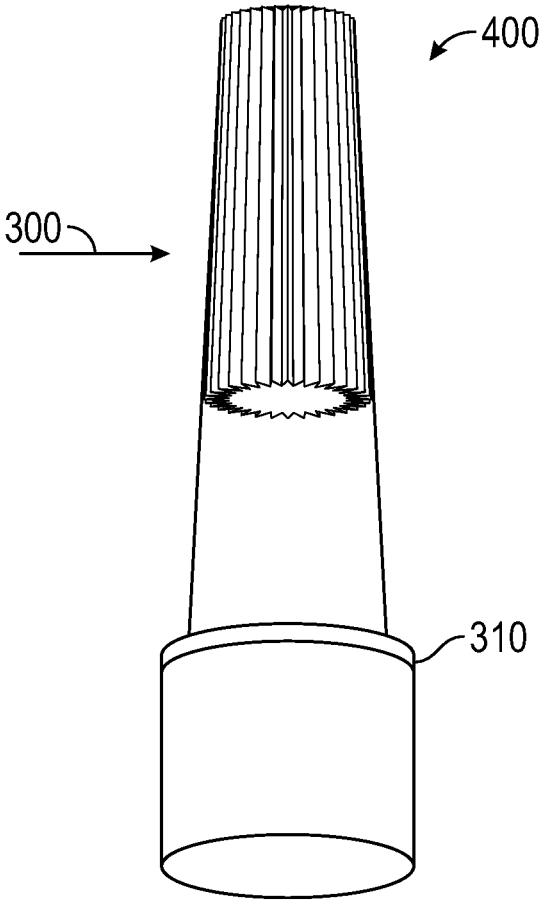
FIGS. 8A and 8B show alternative options that may be implemented for the selectably rotatable paddle solution according to embodiments of the invention.
Figure 8B:
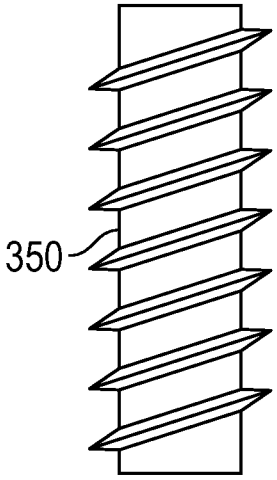

Rotational Adjustability—Post+Screw. Other rotational adjustment embodiments are shown in FIGS. 8A and 8B. FIG. 8A shows pin 300 of a compression bar as a simple post inserted into paddle cavity. Pin 300 may be a simple cylinder that is free to rotate in the cavity and may be set in place at the desired angular rotation simple by a screw, such as a set screw. In another embodiment pin 300 may be multi-sided, such as in the shape of a hexagon with a corresponding hexagonal mating cavity. The user simply inserts pin 300 into paddle cavity at a desire détente angle. Pin 300 may be plastic or metal. In either embodiment snap ring 310 acts to snap pin 300 into its mating cavity. In yet another embodiment shown in FIG. 8B, pin 350 is a threaded post. Pin 350 then screws into paddle cavity with a mating threaded inner circumference. Preferably included in this design is a stop nut that allows paddle angular adjustment to a desired angle A horizontal set screw may also be used in this embodiment to help prevent rotation under pressure. It should be noted that the descriptions contained herein regarding the rotational adjustability do not limit the options only to those described. For example, it can also be envisioned that the pin is part of the paddle, and the cavity is contained in the force-generating member. All of the options and capabilities described previously can be applied to this new configuration except pin and cavity relationship reversed.

Figure 9A:
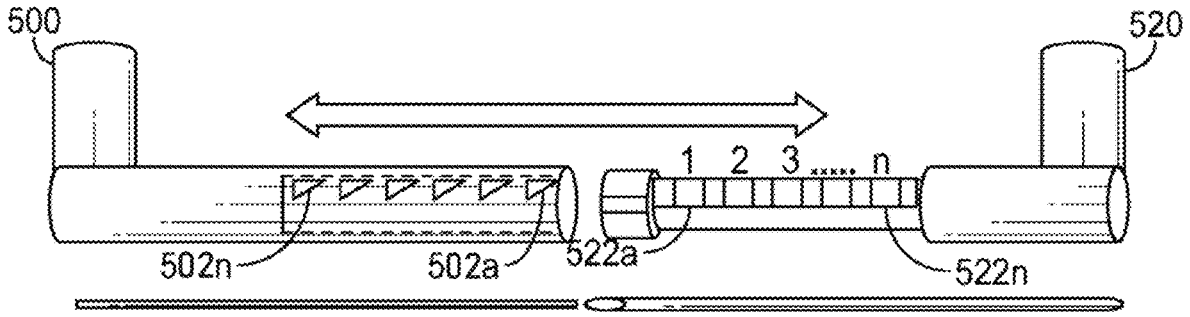
FIGS. 9A and 9B show one preferred embodiment of a bar width adjuster in unassembled and assembled states, respectively, in accordance with the present invention.
Figure 9B:
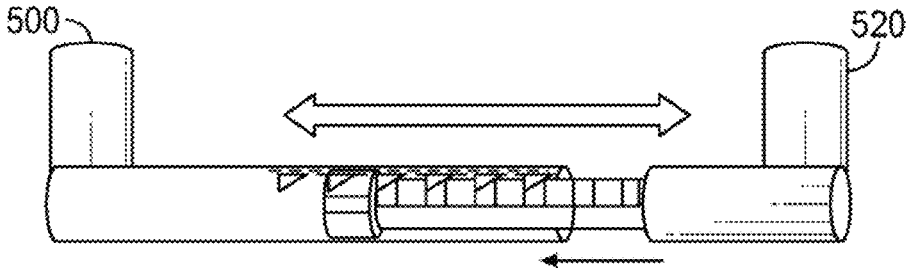

Compression force adjustability—Translation of the Bar. Turning to the second dimension of bra adjustment, compression force adjustability, as discussed above in connection with FIG. 4, the present invention contemplates, in some embodiments, a telescoping compression force bar system, where one of bar components 130 and 140 may slide into a hollow inner cavity of the other. FIGS. 9A and 9B show one such embodiment, whereby left bar component 520 having notched holes 522*a*-522*n* slides into right bar component 500 having angled-teeth like structures 502*a*-502*n*. Each tooth 502 snaps into a notched hole 522 as it passes over it as the two components are pressed together. Moreover, as seen, left bar component 520 may have a visible numbering system printed on it, 1 . . . n, with each number corresponding a translational position of the bar system, with the higher the number corresponding to a greater degree of compression force. Thus, sliding left bar component 520 into right bar component 500 until the first notched hole 522*a* engages first tooth 520*a* resulting in the widest bar adjustment. At the other extreme, sliding component 520 into component 500 the maximum distance, such that tooth 520*n* snaps in hole 522*a* and the tooth 520 (n−1) is notched into hole 522*b* and so forth may results in shortest compression bar that provides the greatest compression force on the wearer's breasts. Since the teeth 520 are biased as shown, translational adjustment in this embodiment can only be made to move in one direction—inward, or from longer to shorter bar system. Thus, to enable the two components 500, 520 to be separated, the present design envisions a release mechanism, such as a twisting action that releases all engaged teeth 502*a*-502*i* by twisting the components and pulling them apart.

Figure 10A:
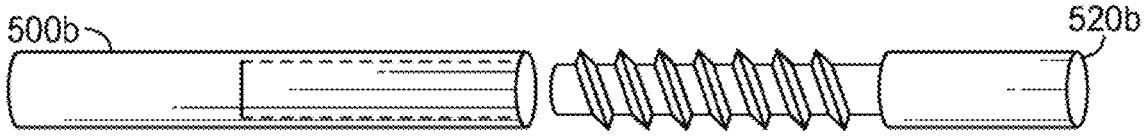
FIGS. 10A and 10B show alternative embodiments of a bar width adjuster in accordance with the present invention.
Figure 10B:
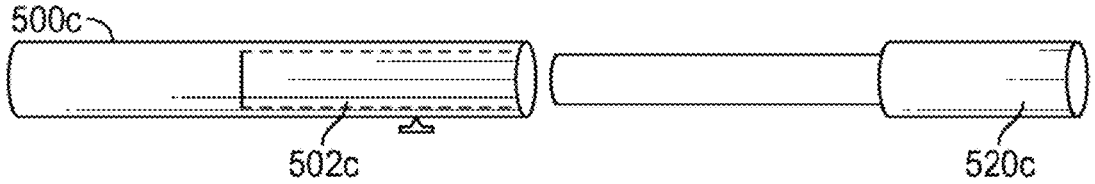

Compression force adjustability—Other Translation Options. FIGS. 10A and 10B show other options for adjusting the length of the bar component system. FIG. 10A contemplates a simple screw-in design, wherein left bar component 520*b* is threaded and screws into the threaded cavity of right bar component 500*b*. The user simply stops screwing the components together at the desired component pair length corresponding to the desire compression force. FIG. JOB shows another simple design whereby left bar component 520*c* is inserted into the cavity of right bar component 500*c* and a trap pin 502*c* is inserted through holes in each component to secure them together. Other options are contemplated and are within the scope of the present invention. Anyone skilled in the art will note that there are many known mechanisms of creating translation in a plastic or metal bar.

Figure 11:
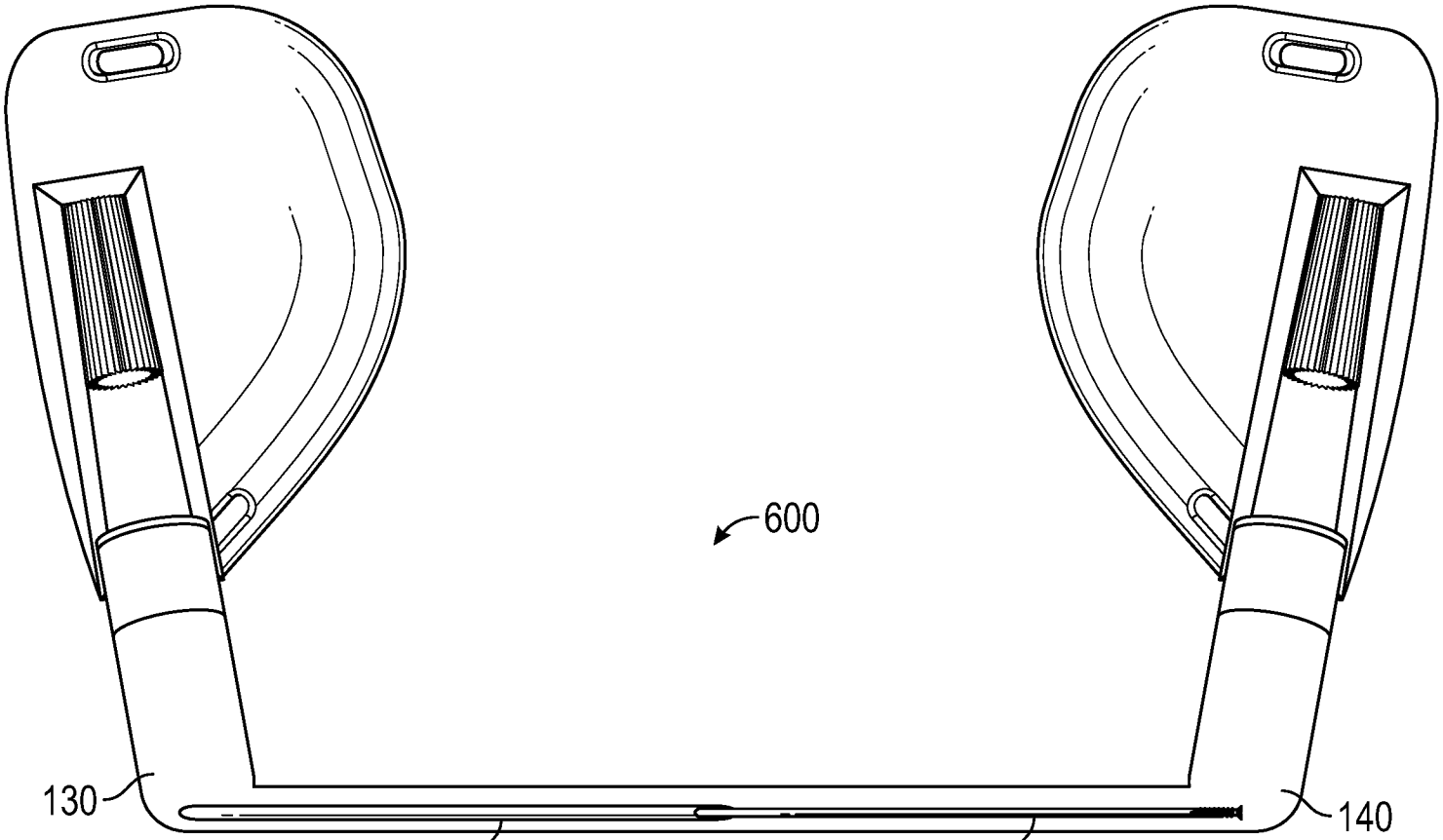
FIG. 11 shows a metal-plastic hybrid compression bar embodiment of the present as an alternative to the inventive design shown in FIG. 4.

The present invention is not limited to using one class of material for all components. Thus, while plastic components may be desirable from the perspectives of producibility (plastic extrusion), weight (low) and cost (low), these designs may also incorporate metal components to improve the strength and integrity of some aspects of the design. Thus, referring to FIG. 11, the base configuration bra system shown in FIG. 4 may be modified with a modified plastic support bar structure that incorporates a metal or other stiff material such as carbon steel, pin subassembly 600*a*, 600*b* through the inner portion of support bar components 130', 140'. As seen, this subassembly may comprise a first thin steel tube 600*a* that receives steel pin 600*b*, providing an increase in the strength of the bar, and, as seen, enabling a potentially very large reduction in the overall diameter of the horizontal mating parts of bar components 130', 140'. In operation, as support bar component 140' is pressed into or pulled away from support bar component 130', pin 600*b* corresponding slides into or away from bar 600*a*, enabling the bra system to provide the desired compression force on the outer sides of the breasts. In this example the any of the mechanisms shown in FIGS. 9 and 10 can be used to translate the length of the bar, while the steel pin subassembly creates the strength required to make the bar much smaller than would otherwise be possible with plastic alone.

The present invention may also use another inventive metal-plastic hybrid solution for the force-generating bar system. As seen in the illustrative cutaway view of FIG. 12, compression bar assembly 700 includes a single stiff metal wire 710 (thus, this configuration does not offer translational adjustment but instead depends on the bending of the wire bar to achieve width adjustment), with an end 712 that is fixed (preferably during manufacturing) into conically-shaped plastic paddle pin 714. Then, typically during user assembly, pin 714 is inserted into the cavity of its mating paddle and rotationally adjusted using any of the configurations discussed above in connection with FIGS. 4-8. As further seen in this hybrid plastic-wire compression bar system, metal wire 710 is configured with a "squiggle-like" bend 720 at the location where wire 710 is wedged into plastic pin 714 as shown. This squiggle configuration stabilizes and provides torque control at the metal-plastic interface to help prevent slipping when a user forcibly rotates a paddle. In another variant of this solution, the plastic pin is molded directly onto the wire and the "squiggle" is employed to create a strong connection of the wire to the pin thus preventing rotation or translation of the plastic pin relative to the wire. It should be noted that the anti-rotation function of the squiggle can be achieved on other ways as well. Approaches such as flattening the bar, splitting the bar or otherwise deforming the bar before molding the wire into the pin assembly may be used to create the means to prevent rotation of the pin assembly with respect to the wire during use of the bra due to torque generated on the paddle during use, translating to the plastic pin and then to the wire.

Figure 12:
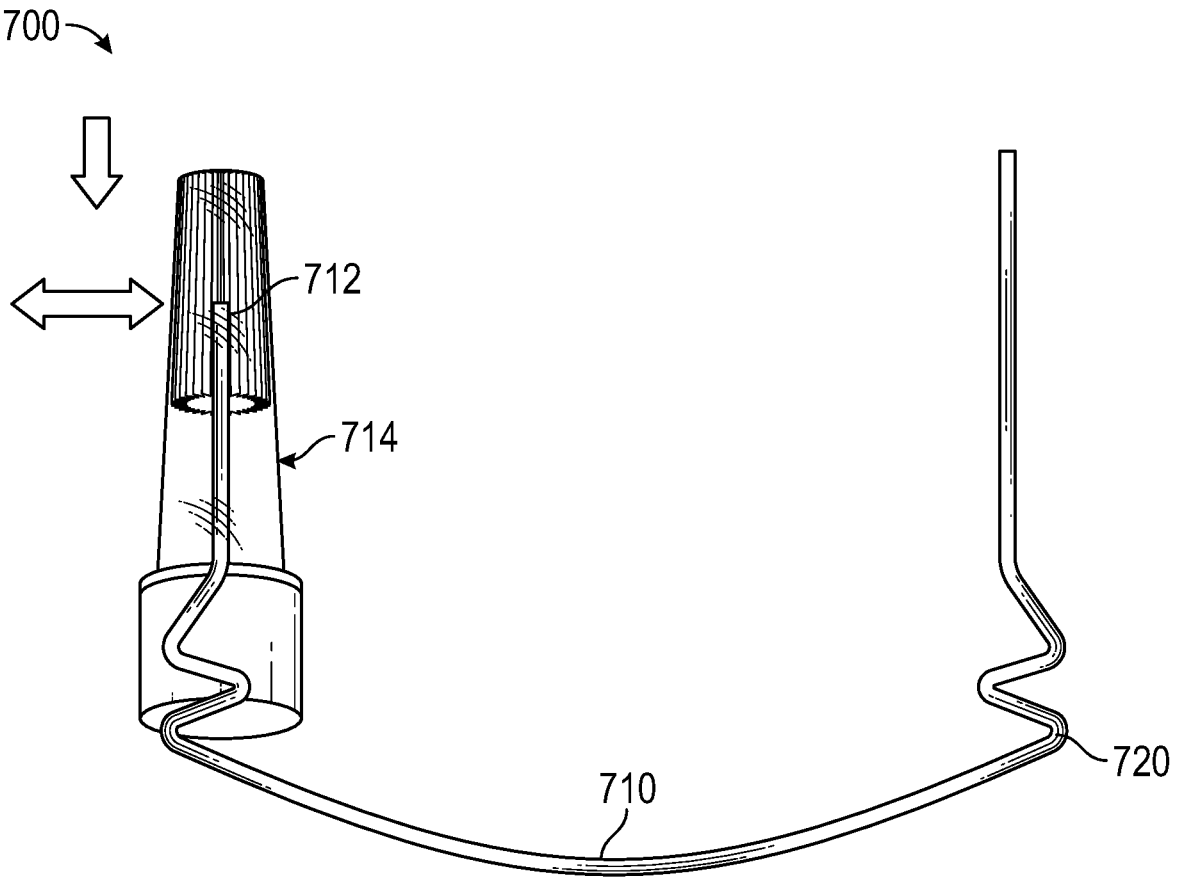
FIG. 12 shows an optional features for a metal-plastic hybrid solution according to embodiments of the invention.

One further option to the configuration shown in FIG. 12 may be whereby wire 710 is extended through pin 714 and sticks out of its top a short distance. In this case, where pin 714 is inserted into paddle 102, pin 714 will connect further into paddle 102 improving the transfer of force from paddle 102 to wire 710 within force-generating assembly 700.

Figure 13:
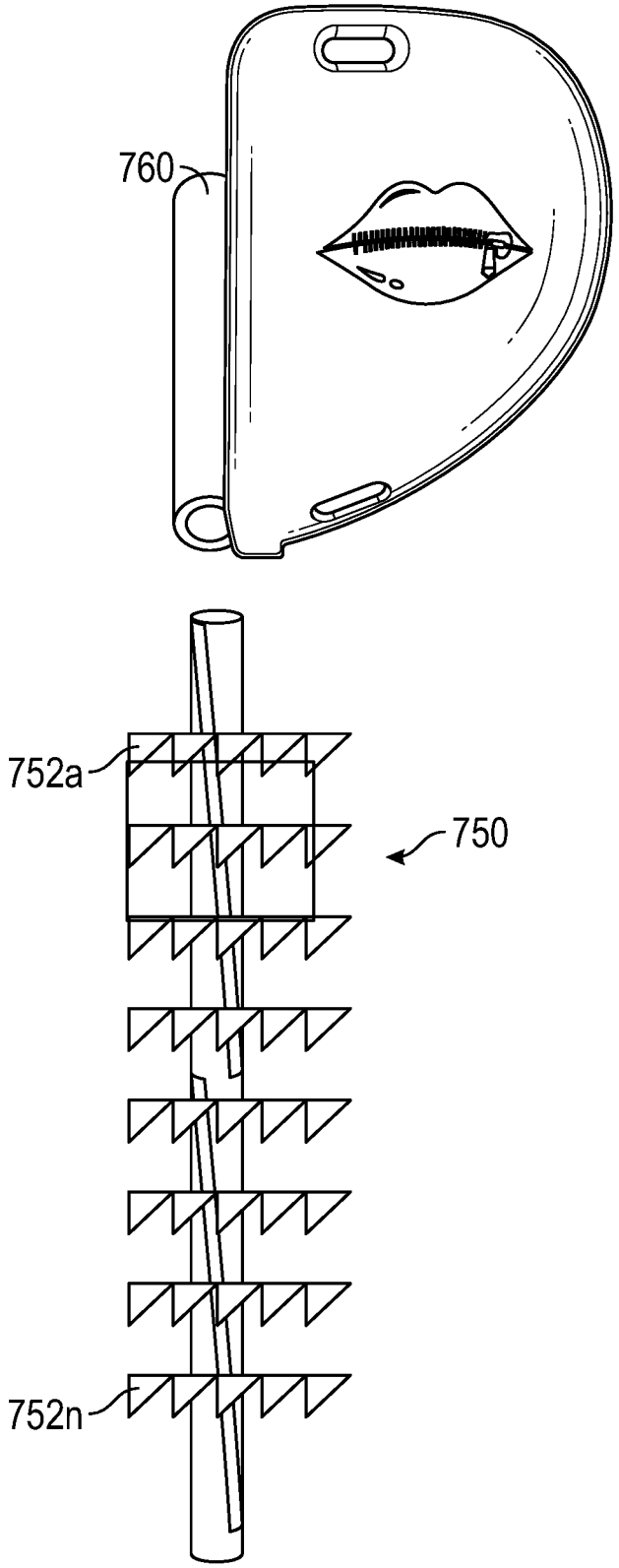
FIG. 13 shows another optional inventive solution to the paddle-bar interface in accordance with another embodiment of the present invention.

A further configuration shown in FIG. 13, may complement or replace the embodiment shown in FIG. 12. As seen, metal sleeve 750 having multiple teeth 752*a*-752*n* is inserted and fixed into paddle cavity 760. A metallic (or other) wire may also have surface conditioning on the sections that are pressed into paddle cavity 760, such that the conditioned sections engage teeth 752*a*-752*n*. Thus, in assembly, a metal-to-metal ratchet interface is created between the conditioned bar and the metal sleeve 740. The end of the bar may be held tightly in the paddle cavity 760 via a press fit with the friction generated between the insert and the cavity wall. In this way a strong support for the paddles are created with an adjustment that occurs between the press fit metal insert and the conditioned metal bar. Due to the small diameter of the wire in this case, a vernier method may be used whereby the teeth are offset within the cavity and the 'ratchet' action is engaged at different physical distances along the wire depending on the angle of the paddle.

Figure 14:
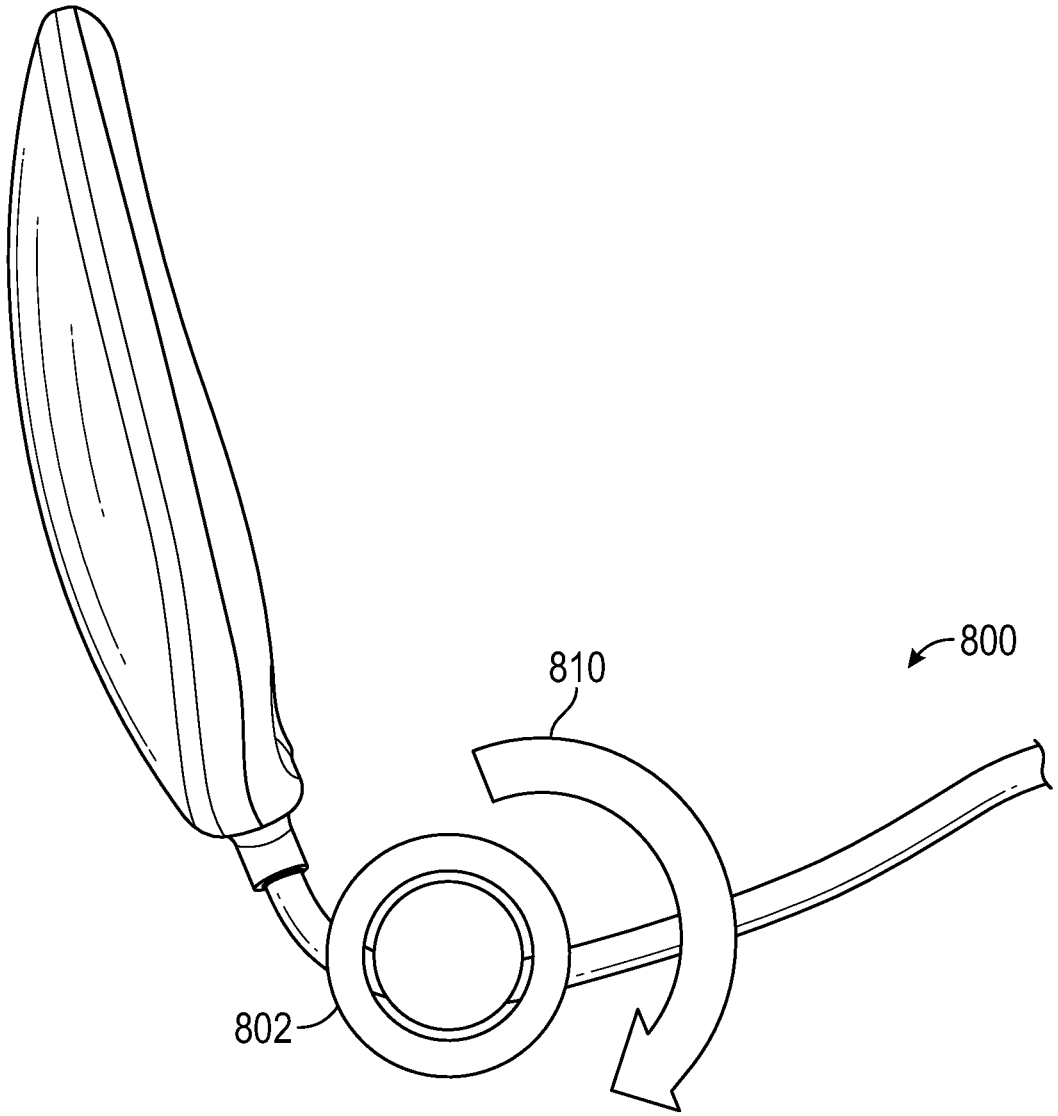
FIG. 14 shows yet another inventive optional adjustable feature of the bra of the present invention.

The present invention also discloses a means for adjusting the "splay" of the paddle relative to the compression bar. Splay is the amount of outward rotation of the paddle relative to the part of the bar that crosses across the user's body. This is shown conceptually in the partial bar view of FIG. 14, where the bend 802 of compression bar 800 includes a selectable rotation mechanism 810, similar in concept to the rotatable ratchet design discussed above.

Thus present invention has thus far been disclosed with respect to paddle and compression bar adjustment. It should be understood however, that in preferred embodiments, while the inventive bra is worn, the paddles, typically plastic, will not directly engage, or touch, the user's breasts. Instead, some soft material, such as soft pads and or fabric and anti-skid or anti-slip material, is typically employed between the inner surfaces of the paddles and the outer sides of the wearer's breasts, as well as on the outer surface of the paddles. In present invention now discloses numerous configurations for these pads as used with any of the embodiments discussed above.

Figure 15:
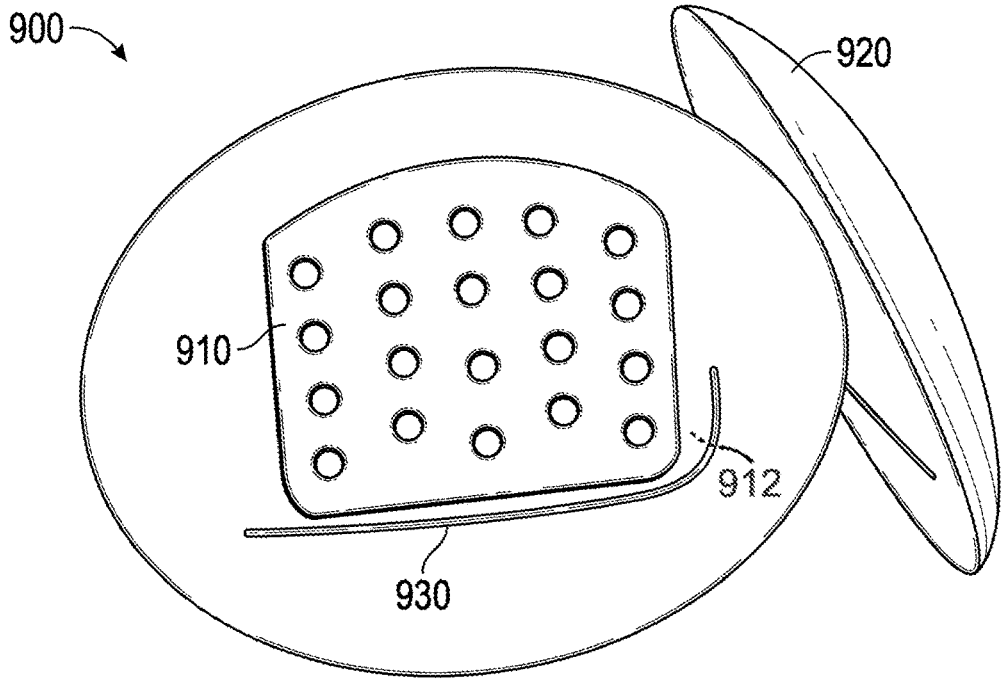
FIG. 15 shows an illustrative diagram of a volumizing pad in accordance with one embodiment of the present invention.
Figure 16:
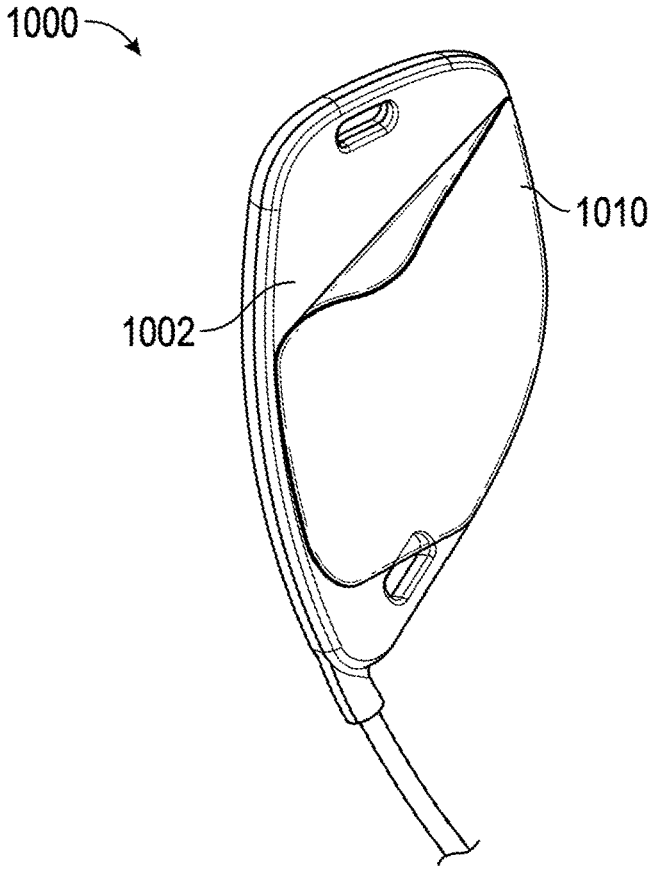
FIG. 16 shows an illustrative diagram of a paddle with the disposition of anti-skid material attached thereon.

As seen in FIG. 15, in one configuration, a volumizing pad 900 is shown having an inner side 910 that interfaces directly with the breasts of the wearer, and outer side 920 that would generally contact the inner side of clothing of the wearer. Antiskid or antislip material may optionally be used by the present invention and it would be attached to the inner side of the volumizing pad. As seen, pad 900 has a hollow pocket 912 between inner side 910 and outer side 920 into which a paddle is inserted via pad slot 930. The paddle may be shifted inside the pocket to affect the best fit of the volumizing pad to the shape of the breast. As further seen in FIG. 16, inner surface 1002 of paddle 1000 may optionally have an anti-skid material 1010 applied to it in order to prevent slippage of pad 900 with respect to paddle 1000 when the paddle is inserted to pad 900 via slot 130 and positioned on it.

In alternative embodiments, a volumizing pad may also be fixed directly to the outside of paddle 1000 without the pocket configuration shown in FIG. 15, in a number of ways. The inner side of the pad may be glued, "Velcroed", or secured using a specialized connection between the pad and the outer side of paddle, such as a slot or a hook formed directly into the plastic paddle outside, or some other connection mechanism as will be understood by those skilled in the art.

Referring back to FIG. 16, anti-skid or anti-slip material 1010 may be attached to the inner side 1002 of the paddle and can take many forms including but not limited to: a thin slice or sticker of material that is sticky on both sides; a coating added to at minimum the inside of the paddle that remains sticky; a sticky material that can flow some amount that is applied to inside of paddle; or a rough surface on inner side of paddle which can grip the volumizing pad directly. This latter embodiment may remove the need for anti-skid material altogether, particularly in cases where the paddle is inserted into the pocket of the volumizing pad. Also, in some implementations sticky material may also be applied to the volumizing pads.

Figures 17A, 17B, 17C:
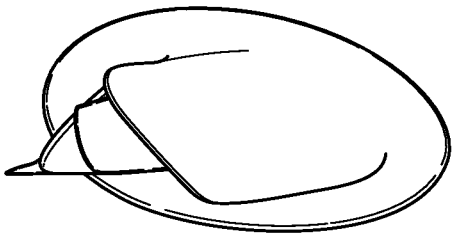
FIGS. 17A-17C conceptually shows component layering options at the paddle/pad interfaces in accordance with embodiments of the present invention.

It should be understood that volumizing pad 900 with pocket 912 in FIG. 15, along with one or more pieces of anti-skid material may take numerous configurations when interfacing with its mating paddle. These layered configurations are symbolically disclosed in FIGS. 17A, 17B and 17C. Thus, in one inventive option seen in FIG. 17A, a novel volumizing pad with a paddle inserted therein has a voluming pad portion whose volumizing outer side is designed to round out the look of the compressed breast and engages the clothing the wearer and an inner side, called here "pocket wall" that meets the outer side of the paddle. The inner side of the pad is novelly constructed with anti-skid or anti-slip material that is embedded directly into and throughout the pad fabric. In this way, this inner side pocket wall can "stick" or stay in place against the inner surface of the paddle, while at the same time the opposite side this inner side of the pad that directly engages the breast can "stick to" the breast. FIG. 17B is similar, but with a few changes including the use a separate anti-skid application on the side of the pad that engages the breast. Also, as seen, there may be no need for additional structure to keep the paddle in place relative to the pad into which it is inserted with the use of a high friction paddle that naturally "grabs" the inner pocket walls of the pad. Finally, FIG. 17C shows a configuration in which anti-skid material is added to both sides of the inner pocket wall of the pad to achieve the needed "sticking" friction of the pad to both the paddle and the wearer's breast.

Figure 18A:
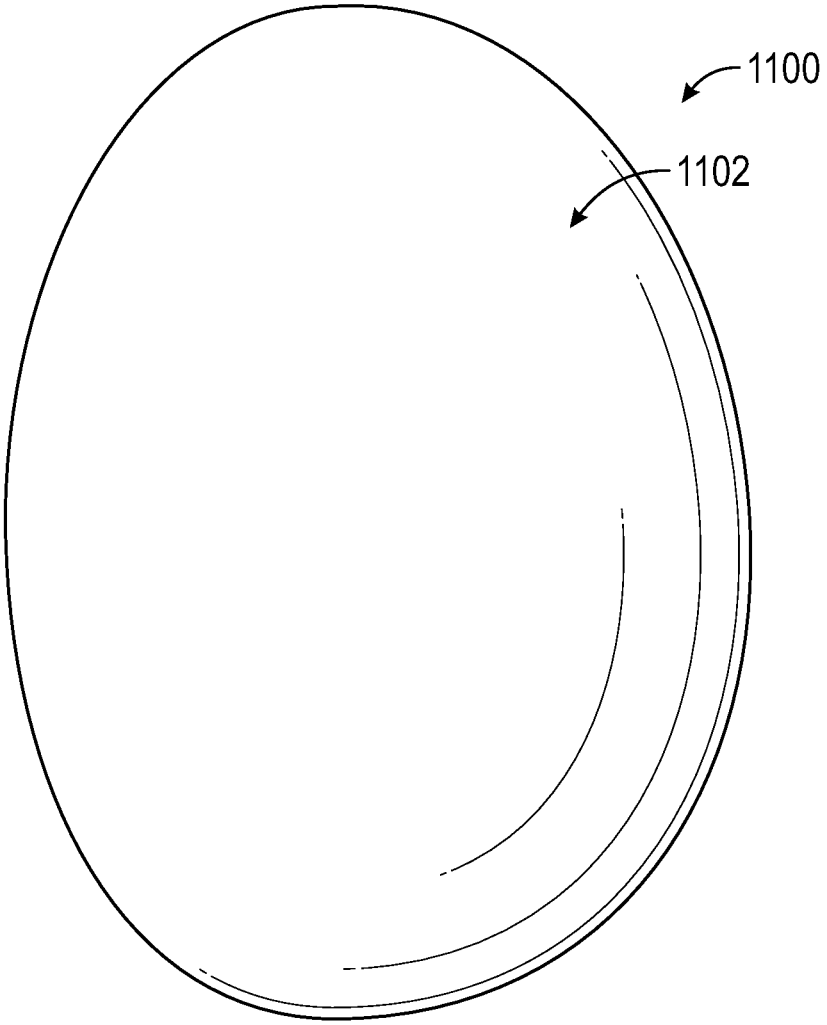
FIGS. 18A-18D show the design of an improved pad in accordance with embodiments of the present invention.
Figure 18B:
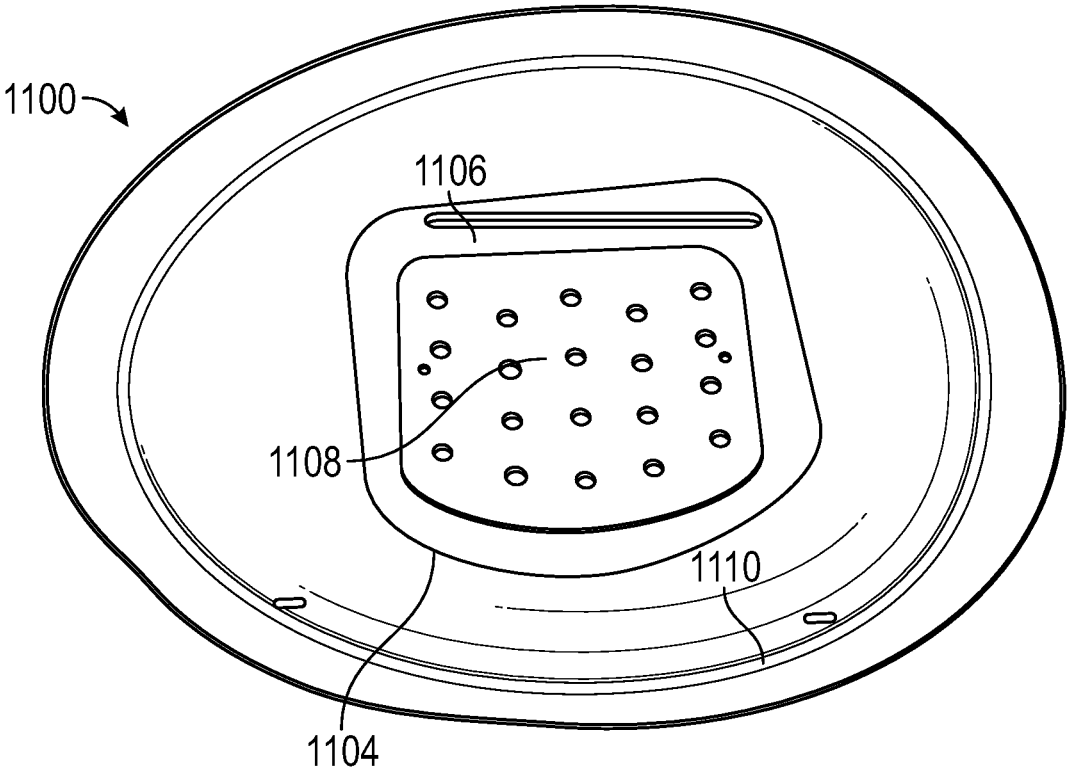
Figure 18C:
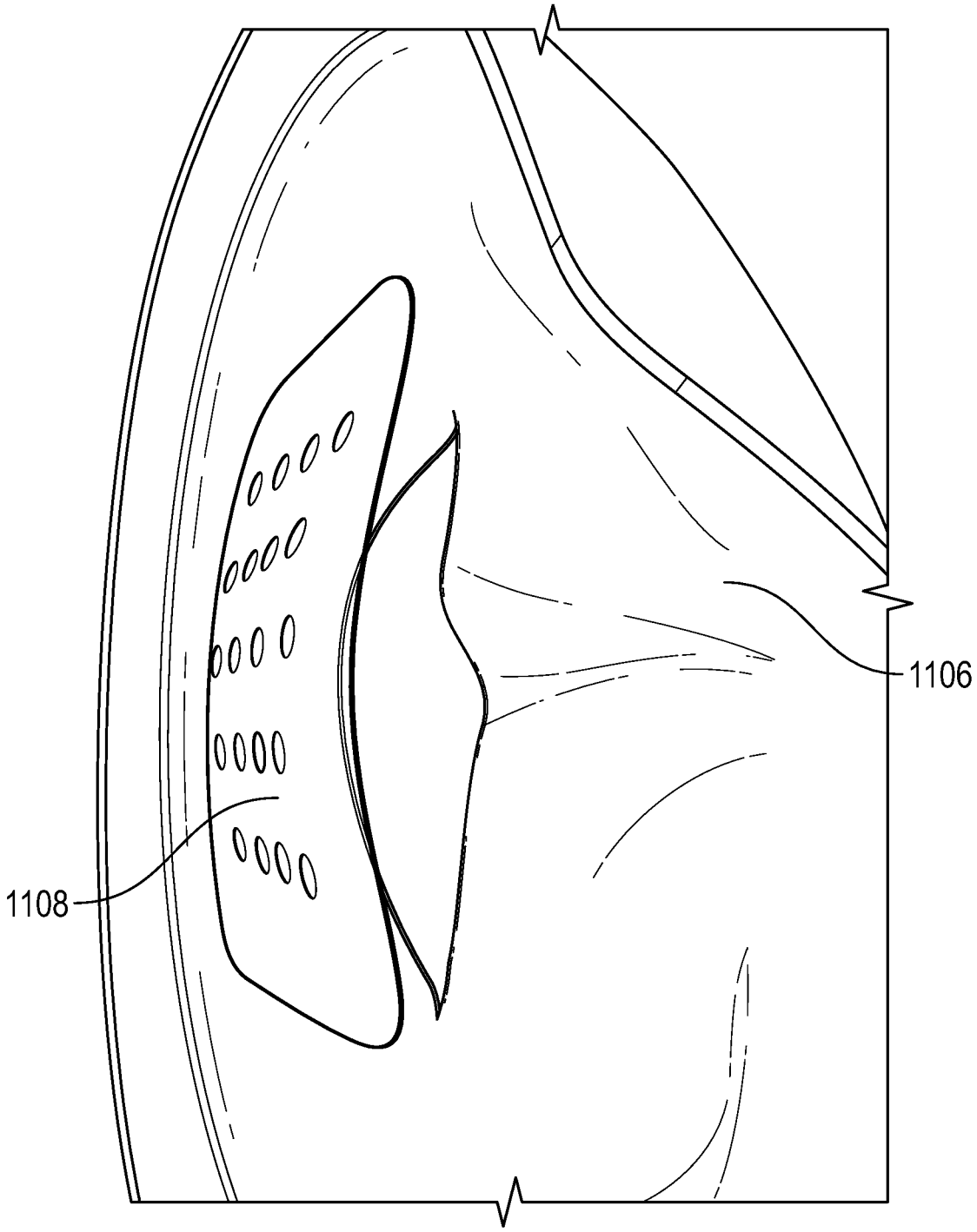

In yet further optional improvements to the pads of the present invention that encase the paddles of the bra system of the present invention, FIGS. 18A-D disclose a two-piece volumizing pad 1100 that is seamless and completely smooth when worn by a user. Pad 1100 comprises a domed, volumizing outer pad component 1102 and a thin inner pad 1104 component having a back side 1104*b*, whose outer perimeter is sealed to the outer perimeter of the back side 1102*b* of outer pad component 1102. Inner pad 1004 has a slot 1106 disposed across a portion of its body serving (as best shown in FIG. 18*c*) as the insertion point for a paddle. When a paddle is first inserted through slot 1106, pad 1100 may be positioned (rotated) about the paddle in accordance with the volumizing shaped desired by the wearer. In some embodiments, once pad 1100 is positioned relative to its inserted paddle, the frictional force applied by the breast that is being forced inward (to create the cleavage effect) will be sufficient keep the pad from moving relative to its paddle. Optionally, to prevent slippage, a small sheet of sticking material may be attached to either the back side 1102*b* of pad 1100 or the back side 1104*b* of thin inner pad 1104, which will engage and hold either the outer surface of the paddle (in the case of the sticking sheet being on the back side 1002*b*) or the inner surface of the paddle.

Moreover, the shape of volumizing pad 1100 is novel and inventive in its own right. In particular, as best seen in FIG. 18*a*, the outer side of volumizing outer pad component 1102 is egg-shaped. This adds great versatility to pad 1100 because it is not only rotatable on a paddle to create the look desired by the wearer's appropriate to her particular breast shape, it is also reversible in the sense that it may be place over either the left breast paddle or right breast paddle.

As further seen in FIG. 18*b*, a sheet of sticky material 1108 that stuck to the outer side of think inner pad 1004 may be provided to provide a sticky friction for the portion of the breast that engages this inner side of pad 1100 so that pad 1100 does not slide down off the breast when worn. In the present embodiment, sheet 1108 comes with a peel-off cover sheet that is peeled off right before wearing. Sheet 1108 may comprise different materials. In one embodiment, it is made from "biogel", which is highly and repeatedly effective to keep engagement against the skin—even with swimming or dancing. Alternatively, sheet 1108 may comprise anti-slip, medical-grade silicon stickers. Sheet 1108 may also include holes across its surface in order to allow the skin to "breath" and sweat.

Figure 18D:
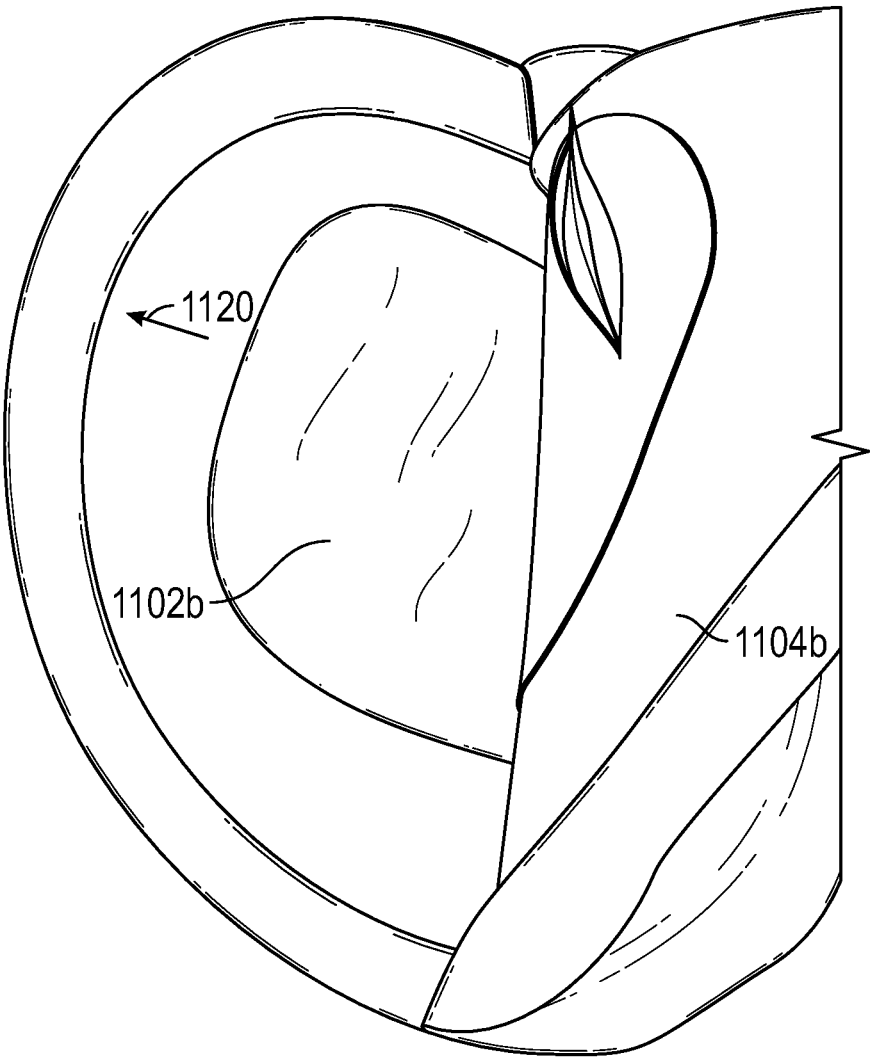

Now will discuss the unique pad design that eliminates bumps or ridges visible over the clothing that covers the bra of the present invention. Turning back to top, back and side views of pad 1100 shown in FIGS. 18*a*-18*c*, the perimeter of pad 1100 has no seams and flares slightly inward such that when placed firmly on a breast the perimeter engages the breast first and slightly deforms to make a smooth pad-breast transition. This is achieved in manufacturing as best seen in FIG. 18*d* by forming outer pad component with a slight ridge 1120 on its inner side 1102*b*. Then, when the inner side 1104*b* of inner pad component 1104, whose area and shape matches that of inner sider 1104*b*, is glued (or otherwise permanently attached) to inner side 1102*b*, the assembly is perfectly smooth and rounded.

It should be understood that the pads of the present invention may be made in any appropriate soft material that provides sufficient volume while being lightweight and comfortable to wear. The pads may also be offered in different sizes to match the size of the user's breasts. In some embodiments, a single Misses Kisses bra kit comprising paddle, compression bar and pad components according to the present invention, four different sized pad sets (or more or less) may be included in one kit covering, for example, petite, regular, large and curvy (extra large) breasts.

While embodiments of the invention have been illustrated and described, it is not intended that these embodiments illustrate and describe all possible forms of the invention. Various changes, modifications, and alterations in the teachings of the present invention may be contemplated by those skilled in the art without departing from the intended spirit and scope thereof. It is intended that the present invention encompass such changes and modification.

We claim:

1. A frontless and backless bra system configured to expose front and back portions of a wearer's body when worn and adapted to provide enhanced cleavage for the wearer's first and second breasts, each breast having an outer side, the bra system comprising:

a first compression paddle for engaging directly or indirectly at least a portion of the outer side of the first breast of the wearer;

a second compression paddle for engaging directly or indirectly at least a portion of the outer side of the second breast of the wearer; and a force-generating member having a first end connected to a lower end of the first compression paddle and a second end connected to a lower end of the second compression paddle, each end of the member configured to extend downwardly away from the breasts toward the abdomen of the wearer, wherein each compression paddle is rotatably adjustable around a respective fixed axis of rotation defined by the force-generating member end that is connected to the respective compression paddle and is rotatably adjustable to a desired fixed angular position selected based at least in part on the size of the wearer's breast engaged by the paddle; and wherein each of the first compression paddle and the second compression paddle further comprises:

a first surface contoured and configured to engage with at least a portion of a user's breast;

a mechanical coupling configured to engage with an end of the force generating member; and a locking mechanism configured to:

engage a rotational state wherein the compression paddle is configured to rotate about an axis that is substantially coaxial to the end of the force generating member; and engage a locked state wherein the compression paddle is mechanically locked at an angular position selectable by the user.

2. The bra system of claim 1, wherein each compression paddle is rotatably adjustable around the respective fixed axis of rotation to any one of a plurality of fixed angular positions selected based at least in part on the size of the wearer's breast engaged by the paddle.

3. The bra system of claim 2, wherein each paddle is fixed to the desired angular position with respect to its mating force-generating member end based at least in part on the friction created between the paddle lower end and the respective end of the force-generating member when connected.

4. The bra system of claim 1, wherein each paddle includes a cavity extending into the lower end of the paddle and each end of the force-generating member includes a pin that mates with the cavity of the lower end of the paddle into which the pin is inserted.

5. The bra system of claim 4, wherein each pin of the force-generating member includes a plurality of teeth on an outer circumference of the pin and the respective cavity of the corresponding paddle includes a plurality of teeth on its inner circumference, such that when assembled the plurality of pin teeth mate with the plurality of paddle cavity teeth and the angular position of the paddle may be moved and then fixed by the teeth to a desired angular position.

6. The bra system of claim 5, wherein the plurality of pin teeth and the mating plurality of paddle cavity teeth are angled, such that when assembled the angular position of the paddle may be rotated in one rotational direction and fixed to a desired angular position but may not be rotated in the opposite rotational direction.

7. The bra system of claim 1, wherein the force-generating member is plastic.

8. The bra system of claim 1, wherein the force-generating member comprises first and second bars, with the first bar comprising the first end and an opposite end, and the second bar comprising the second end and an opposite end, wherein the opposite ends of the first and second bars connect to each other to enable translational adjustment of the force-generating member.

9. The bra system of claim 8, wherein the opposite ends of the bars are tubular having inner channels, and the opposite end of one of the first and second bars slides into the channel of the other bar, thereby enabling the width of the force-generating member to be adjusted.

10. The bra system of claim 1, wherein the force-generating member comprises a plastic-metal hybrid bar.

11. The bra system of claim 1, further including a first volumizing pad into which the first compression paddle is inserted and a second volumizing pad into which the second compression paddle is inserted, with each pad having an inner surface that tracks the contour of the inner surface of the respective first or second paddle and is configured to engage the outer side of a breast, and an outer surface that is configured to provide replacement volume to the outer side of each breast when compressed by the respective paddle.

12. The bra system of claim 11, further including anti-slip material disposed on a portion of the inner surface of each pad, to prevent the pad and the respective inserted paddle from slipping off the breast that the pad engages.

13. The bra system of claim 12, further including anti-slip material or an anti-slip coating disposed on at least a portion of the inner surface of each paddle, to prevent the paddle from slipping with respect to the volumizing pad into which the paddle is inserted.

14. The bra system of claim 1, wherein after assembly, the wearer may adjust a translational position of the force-generating member, based at least in part on the desired compression force desired on the outer sides of the wearer's breast.

15. The bra system of claim 1 further comprising a plurality of different force generating members and wherein the first compression paddle and the second compression paddle are configured to be removably connectable to each of the plurality of different force generating members.

16. The bra system of claim 15 wherein the plurality of different force generating members further comprise: a first force generating member configured for creating a shallow plunge bra system; a second force generating member configured for creating a mid-plunge bra system; and a third force generating member configured for creating a deep plunge bra system.

* * * * *